United States Patent [19]

Rasmussen

[11] Patent Number: 5,026,320

[45] Date of Patent: Jun. 25, 1991

[54] DISC-TYPE COIN SORTER WITH RETRACTABLE GUIDE SURFACES

[75] Inventor: James M. Rasmussen, Chicago, Ill.

[73] Assignee: Cummins-Allison Corporation, Mt. Prospect, Ill.

[21] Appl. No.: 432,625

[22] Filed: Nov. 6, 1989

[51] Int. Cl.[5] ..... G07D 3/16

[52] U.S. Cl. ..... 453/6; 453/32

[58] Field of Search ..... 453/6, 10, 32

[56] References Cited

U.S. PATENT DOCUMENTS

| | | | |
|---|---|---|---|
| 4,564,036 | 1/1986 | Ristvedt | 453/10 |
| 4,570,655 | 2/1986 | Raterman | 453/10 |
| 4,607,649 | 8/1986 | Taipale et al. | 453/6 |
| 4,681,128 | 7/1987 | Ristvedt et al. | 453/6 |

FOREIGN PATENT DOCUMENTS

| | | | |
|---|---|---|---|
| 2193364 | 2/1988 | United Kingdom | 7/3 |

*Primary Examiner*—F. J. Bartuska

*Attorney, Agent, or Firm*—Arnold, White & Durkee

[57] ABSTRACT

A disc-type coin sorter has a rotatable disc with a resilient top surface and a stationary sorting head positioned above the disc with the lowermost surface of the sorting head only slightly spaced from the resilient top surface of the disc. The sorting head has coin queuing device for arranging coins of mixed denominations in a single row and a single layer with selected edges of the coins aligned at a common radial position. A first guide surface engages selected edges of the aligned coins and progressively moves the engaged coins radially as the coins move circumferentially along the first guide surface. A plurality of elongated second guide surfaces spaced radially from, and facing toward, the first guide surface force coins of selected denominations past the first guide surface at selected circumferential locations. Each of the elongated second guide surfaces has a substantially constant radius from the axis of rotation of the disc so that the coins engaged thereby are not moved radially. The distance between the first and second guide surfaces progressively decreases in the circumferential direction so that coins of progressively smaller diameter are engaged by successive second guide surfaces. The plurality of second guide surfaces are located at different radial distances from the axis of rotation so that the edges of each denomination of coin forced past the first guide surface are located at a unique radial position, thereby permitting discrimination among coins of different denominations according to the radial positions of the edges of the coins. The second guide surfaces may be retracted from the path of the coins on the disc for recycling the coins, and a counting device may be connected to the second guide surfaces for sensing engagement of each separate coin with one of the second guide surfaces.

8 Claims, 2 Drawing Sheets

FIG. 1
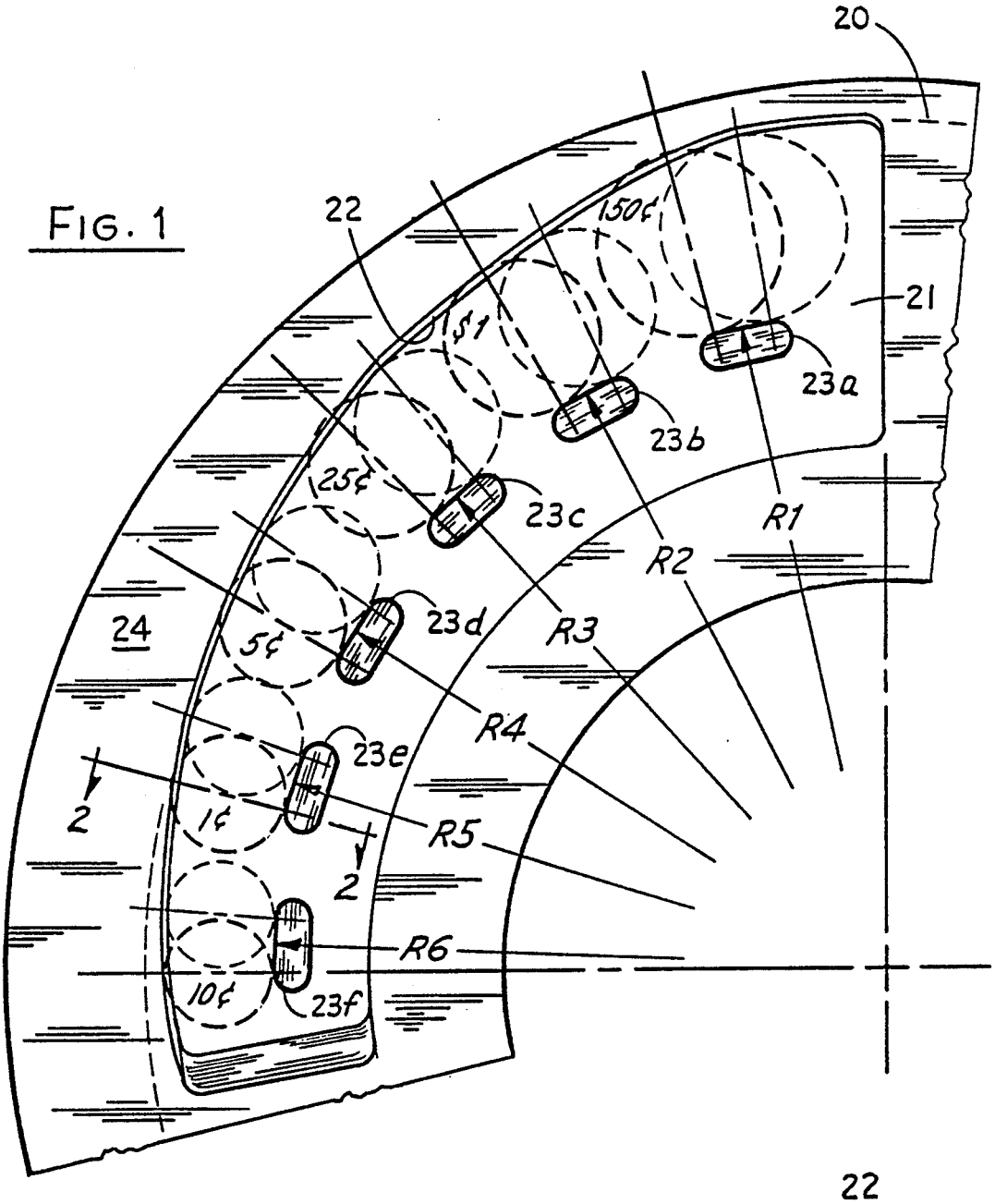
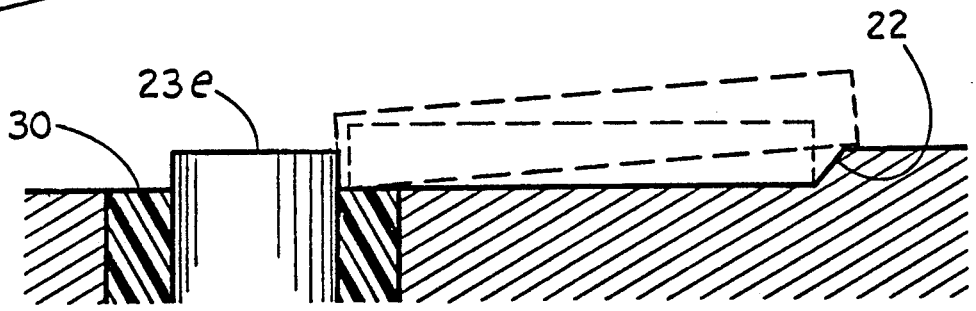
FIG. 2

DISC-TYPE COIN SORTER WITH RETRACTABLE GUIDE SURFACES

BACKGROUND OF THE INVENTION

The present invention relates generally to coin sorters and, more particularly to disc-type coin sorters which have a rotatable disc with a resilient top surface for rotating coins of mixed denominations beneath a stationary head having a configured lower surface for manipulating and sorting coins as they are rotated.

SUMMARY OF THE INVENTION

It is a primary object of the present invention to provide an improved disc-type sorter which minimizes abrasion and wear on both the coins and the coin-manipulating surfaces on the stationary head.

A related object of this invention is to provide such an improved disc-type coin sorter which has a long operating life, and which requires a minimum amount of maintenance and infrequent replacement of parts.

It is another object of this invention to provide an improved disc-type coin sorter which can be efficiently fabricated at a relatively low cost as compared with coin sorters providing a comparable performance.

Other objects and advantages of the invention will be apparent from the following detailed description and accompanying drawings.

In accordance with the present invention, the foregoing objectives are realized by providing a disc-type coin sorter having a rotatable disc with a resilient top surface and a stationary sorting head positioned above the disc with the lowermost surface of the sorting head only slightly spaced from the resilient top surface of the disc, the sorting head having coin queueing means for arranging coins of mixed denominations in a single row and a single layer with selected edges of the coins aligned at a common radial position; a first guide surface for engaging selected edges of the aligned coins and progressively moving the engaged coins radially as the coins move circumferentially along the first guide surface; a plurality of elongated second guide surfaces spaced radially from, and facing toward, the first guide surface for forcing coins of selected denominations past the first guide surface at selected circumferential locations, each of the elongated second guide surfaces having a substantially constant radius from the axis of rotation of the disc so that the coins engaged thereby are not moved radially; the distance between the first and second guide surfaces progressively decreasing in the circumferential direction so that coins of progressively smaller diameter are engaged by successive second guide surfaces; and the plurality of second guide surfaces being located at different radial distances from the axis of rotation so that the edges of each denomination of coin forced past the first guide surface are located at a unique radial position, thereby permitting discrimination among coins of different denominations according to the radial positions of the edges of the coins. In a preferred embodiment, the sorter includes means for retracting the second guide surfaces from the path of the coins on the disc so that the coins can be recycled in response to the detection of a selected condition, and counting means connected to the second guide surfaces for sensing the engagement of each separate coin with one of the second guide surfaces.

BRIEF DESCRIPTION OF THE DRAWINGS

In the drawings:

FIG. 1 is a bottom plan view of a portion of the configured surface of stationary sorting head embodying the present invention;

FIG. 2 is an enlarged section taken generally along line 2—2 in FIG. 1;

DETAILED DESCRIPTION OF THE PREFERRED EMBODIMENTS

Figure 4:
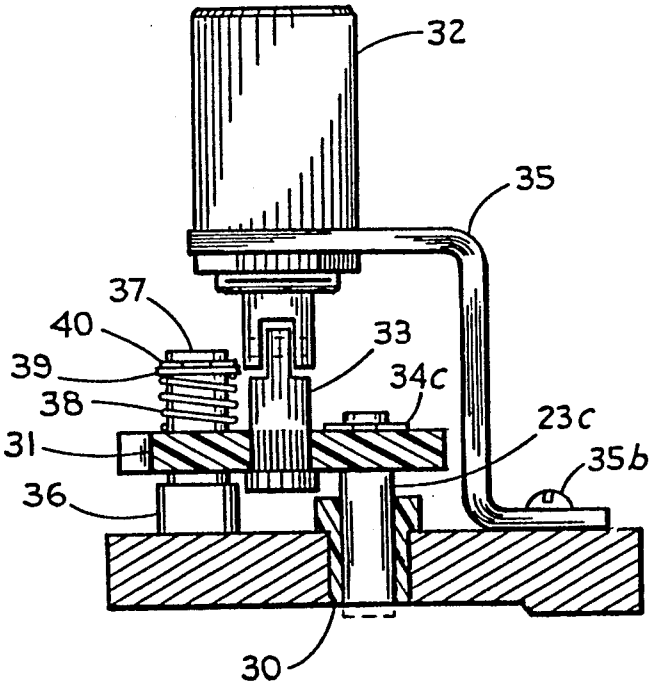
FIG. 4 is a section taken generally along line 4—4 in FIG. 3.

While the invention will be described in connection with certain preferred embodiments, it will be understood that it is not intended to limit the invention to these particular embodiments. On the contrary, it is intended to cover all alternatives, modifications and equivalent arrangements as may be included within the spirit and scope of the invention as defined by the appended claims.

Turning now to the drawings and referring to FIG. 1, there is shown a portion of a sorting head for use in a disc-type coin sorter of the type described, for example, in Ristvedt U.S. Pat. No. 4,681,128, issued July 21, 1987. As is well known in the coin-sorting art, a disc-type coin sorter typically has a motor-driven disc with a resilient pad on the upper surface of the disc. This disc is rotated beneath a stationary sorting head having a configured lower surface for manipulating and sorting mixed denominations of coins as they are moved circumferentially beneath the head by the rotating disc. The stationary head has a central opening through which coins are fed from a hopper on the top of the head onto the central portion of the resilient surface of the rotating disc. The rotation of the disc causes the coins to move outwardly across the surface of the disc into the space between the stationary head and the rotating disc.

After the coins have entered the space between the stationary head and the rotating disc, the configured surface on the underside of the head arranges the coins in a single row and a single layer. Various configurations are known in the art for achieving this "queueing" of the coins, and one example of a suitable coin-queueing arrangement is described in the aforementioned Ristvedt U.S. Pat. No. 4,681,128. Another example is described in Raterman U.S. Pat. No. 4,570,655 issued Feb. 18, 1986.

After queueing, the single row and single layer of coins are led into a region of the space between the rotating disc and the stationary head where the coins are pressed by the bottom surface of the stationary head into the resilient surface of the rotating disc, so that the coins are held in a fixed radial position by the pressure applied to opposite surfaces of the coin. Normally, the coins are positioned with either the outer edges or the inner edges of the coins of all denominations at a constant radius from the axis of rotation of the disc. The coins continue to move circumferentially around the sorting head as long as the disc continues to rotate.

In the particular embodiment of the present invention illustrated in FIG. 1, the sorting head aligns the coins of all denominations with their outer edges located at a common radius illustrated by the broken-line arc 20. As the coins are rotated with their outer edges following the arc 20, the coins of all denominations enter a recess 21 having an outer edge 22 which forms an outer guide surface facing inwardly for engaging the outer edges of the aligned coins. This guide surface 22 spirals inwardly so that it progressively moves the engaged coins radially inwardly as the coins move circumferentially along the guide surface. As can be seen more clearly in the sectional view in FIG. 2, the outer guide surface 22 is tapered at an angle of less than 45° from vertical, for reasons which will be described in more detail below.

As the coins are advanced along the guide surface 22, the inner edges of the coins of each different denomination engage one of a series of circumferentially spaced guide members 23*a*, 23*b*, 23*c*, 23*d*, 23*e* and 23*f*. Each of these guide members has an outer surface which is spaced radially from, and faces outwardly toward, the guide surface 22. As will be described in more detail below, the guide members 23*a*–23*f* force the coins of different denominations outwardly past the guide surface 22 at different circumferential positions along the length of the guide surface 22.

The illustrative sorter is designed for sorting the six coin denominations of United States currency. Thus, the largest of those six coins (the half dollars) engage the first guide member 23*a*, which is spaced further away from the guide surface 22 than any of the succeeding guide members 23*b*–23*f*. The outer surface of the guide member 23*a* follows a constant radius R1 from the axis of rotation of the rotating disc, while the opposed portion of the guide surface 22 has a progressively decreasing radius as measured from the axis of rotation. Consequently, the radial distance between the guide surface 22 and the outer surface of the guide member 23*a* decreases progressively in the direction of coin movement as the guide surface 22 converges toward the guide surface formed by the member 23*a*. More specifically, this radial distance is at least as great as the diameter of the half dollar at the entry end of the guide member 23*a*, and is substantially less than the diameter of the half dollar at the exit end of the guide member 23*a*. Thus, as a half dollar traverses the guide member 23*a*, the outer edge of the half dollar is forced outwardly past the guide surface 22, as illustrated by the two half dollars shown in broken lines in FIG. 1. The taper of the guide surface 22 enables the coins to pass thereunder.

The surface 24 of the sorting head outboard of the guiding surface 22 is a portion of the lowermost surface of the head. That is, this portion of the head surface is located closer to the top surface of the resilient pad on the rotating disc than any other portion of the head. A typical spacing between the surface 24 and the uppermost surface of the disc is 0.001 to 0.003 inch. Consequently, when a coin is forced past the guide surface 22, that coin is pressed firmly between the surface 24 of the sorting head and the resilient surface on the top of the rotating disc, thereby holding that coin in a fixed radial position as it continues to be moved circumferentially by the rotation of the disc. In the case of the half dollar, this fixed radial position is determined by the guide member 23*a*, i.e., every half dollar is positioned with its inner edge at the radius R1 defined by the outer surface of the guide member 23*a*. As will be apparent from the ensuing description, the half dollars continue to travel circumferentially with their inner edges at this radius R1 until they are exited from the sorting head.

As can be seen in FIG. 1, the distance between the guiding surface 22 and the outer surfaces of successive guide members 23*b*, 23*c*, 23*d*, 23*e* and 23*f* progressively decreases in the circumferential direction, so that coins of progressively smaller diameter are engaged by successive guide members 23*b*–23*f*. Specifically, the dollar coins engage the guide member 23*b*, the quarters engage the guide member 23*c*, the nickels engage the guide member 23*d*, the pennies engage the guide member 23*e*, and the dimes engage the guide member 23*f*. In each case, the guide member has the same effect described above for the guide member 23*a* on the half dollar, i.e., the guide member forces the corresponding coin engaged thereby outwardly past the guide surface 22 so that that particular denomination of coin continues to be rotated with its inner edge held at a constant radial position defined by the radius of the outer surface of the corresponding guide member.

As can also be seen in FIG. 1, the outer surfaces of the successive guide members 23*b*–23*f* are located at different radial distances R2, R3, R4, R5 and R6 from the axis of rotation of the disc, so that the inner edges of each denomination of coin are located at a unique radial position. Thereby permits subsequent discrimination of coins of different denominations according to the radial positions of the inner edges of the coins. For example, the inner edges of the dollar coins are located at radius R2, which is spaced inwardly from the radius R1 of the inner edges of the half dollars. Similarly, the inner edges of the quarters are located at radius R3, the inner edges of the nickels are located at radius R4, the inner edges of the pennies are located at radius R5, and the inner edges of the dimes are located at radius R6. These different radii preferably differ from each other by at least 0.50 inch, to facilitate discrimination among the different coin denominations. For example, in one particular embodiment, the radii R1–R6 have dimensions of 4.250, 4.200, 4.150, 4.100, 4.050 and 4.000 inches, respectively.

It will be noted that the outer surface of each successive guide member 23*a*–23*f* is spaced radially inwardly from the radius of the outer surface of all preceding guide members, so that any coin which engages a preceding guide member clears all succeeding guide members. For example, the half dollars engage the guide member 23*a* which positions the inner edge of that particular coin denomination at a radius R1, and then the half dollars remain with their inner edges at the radius R1 and thus clear all succeeding guide members 23*b*–23*f*. Also, the exit end of the outer surface of each guide member is spaced from the outer guide surface 22 by a distance greater than the diameter of the next smaller coin. Each guide member, therefore, engages the coins of only one denomination As the coins continue to be carried by the rotating disc, after they have all been moved outwardly past the guide surface 22, they are ultimately discharged from the space between the rotating disc and the sorting head by providing an inwardly spiraling outer edge on the sorting head. As the outer edge of the head spirals inwardly, it releases the coins of different denominations successively at different circumferential locations according to the radial positions of the inner edges of the coins. Because the half dollars have their inner edges at the radially outermost positions, the half dollars exit first, then the dollars, then the quarters and so on. This discharge arrangement is not shown in the drawings, because it is the same arrangement shown in the aforementioned Ristvedt U.S. Pat. No. 4,681,128.

It is often desirable for coin sorters to have what is commonly referred to as a "bagstop" feature. This means that the sorter stops the discharge of coins after a preselected number of coins of a selected denomination have been discharged into a coin bag or box. Most coin sorters have automatic counters for each different denomination of coins. In the illustrative sorting head shown in FIG. 1, the guide members 23*a*–23*f* may be used as the sensing means for the counters by generating an electrical signal each time a coin engages one of the guide members 23*a*–23*f*. This is accomplished by insulating each of the guide members 23*a*–23*f* from the sorting head by means of an insulating sleeve 30 (FIGS. 2 and 4) and applying an electrical voltage across the guide member 23 and the sorting head. The electrical circuit remains open except when the guide member is physically engaged by a coin, which of course is also in contact with the sorting head. Thus, whenever a coin engages the guide member 23, an electrical signal is supplied to one of the corresponding counter which accumulate numbers representing the number of coins of each denomination that have contacted the respective guide members 23*a* and 23*f*.

Figure 3:
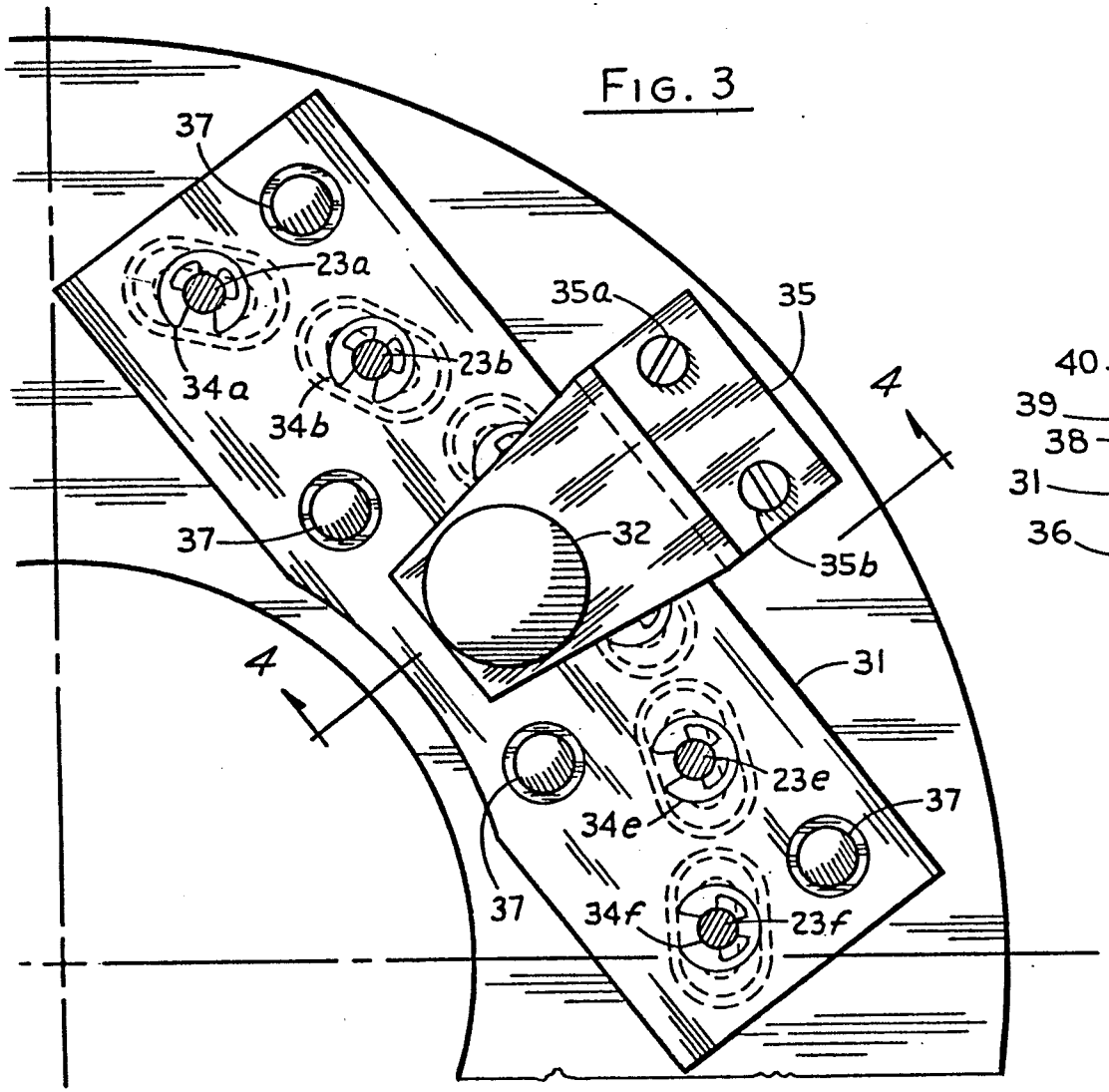
FIG. 3 is a top plan view of the same portion of the sorting head shown in FIG. 1.

After a preselected number of coins of a selected denomination have been counted, the discharge of additional coins is stopped by retracting all the guide members 23*a*–23*f* upwardly into the sorting head so that the six guide members are all withdrawn from the coin path. As long as the guide members are in this retracted position, the coins of all denominations will simply follow the guide surface 22 and be returned to the central portion of the sorting head for another cycle. The mechanism for retracting the guide members 23*a*–23*f* is illustrated in FIGS. 3 and 4. All six guide members 23*a*–23*f* are fastened to a single mounting plate 31, which in turn is connected to a solenoid 32 by means of a pull rod 33. In the particular arrangement illustrated, each guide member is provided with a circumferential groove for receiving a locking washer 34 above the mounting plate 31, and the pull rod is connected to the core of the solenoid by means of a locking pin. The solenoid 32 is supported on a mounting bracket 35 attached to the top surface of the sorting head by a pair of screws 35*a* and 35*b*.

The guide members 23*a*–23*f* are normally held in their lowered, advanced positions shown in FIGS. 2 and 4, for engaging the coins passing thereby. This advanced position of the guide members is determined by a stop 36 which is mounted on the top surface of the sorting head for engaging the lower surface of the mounting plate 31. The mounting plate 31 is made of an insulating material so that it does not provide a short circuit between the guide members and the sorting head. On top of the mounting plate 31, four slide rods 37 extend upwardly therefrom, and each rod is surrounded by a return spring 38 for urging the mounting plate 31, downwardly against the stop 36. The return spring 38 is held in place by means of a washer 39 and a locking washer 40 received in a circumferential groove in the slide rod 37.

When a preselected number of coins of a given denomination have been counted, the solenoid 32 is energized by the counter which has been receiving signals from the guide member 23 corresponding to that particular coin denomination. Energization of the solenoid 32 raises the mounting plate 31 upwardly against the biasing force of the spring 38. As already explained, this upward movement of the plate 31 retracts the guide members 23*a*–23*f* upwardly into the sorting head, thereby removing the guide members from the path of the coins being carried on the surface of the rotating disc. The solenoid remains energized, holding the plate 31 in the raised position, until it is desired to re-start the sorting operation. This gives the operator time to remove the bag or box of coins containing the desired number of coins of the selected denomination, and to replace that full bag or box with an empty receptacle. The operator then activates a switch which deenergizes the solenoid 32, enabling the return spring 38 to return the plate 31 to its advanced position against the stop member 36, thereby returning the guide members 23*a*–23*f* to their operative, lowered positions.

In order to prevent additional coins from entering the queuing region of the sorting head while the solenoid 32 is energized, it is preferred to provide a solenoid-operated coin deflector at the entry to the queuing region. Such solenoid-operated deflectors are known in prior art sorters, such as those described, for example, in Raterman U.S. Pat. No. 4,570,655 issued Feb. 18, 1986, and in Ristvedt published British Patent Application No. 2,193,364, published Feb. 2, 1988.

Instead of initially aligning the coins with their outer edges at a common radial position, the coins may be initially aligned with their inner edges at a common radial position. The coins are then advanced so that the inner edges of the coins of all denominations follow an outwardly facing guide surface which spirals outwardly. The guide members 23*a*–23*f* are then located outboard of the inner guide surface, so that the inside surfaces of the guide members form outer guide surfaces facing the spiral inner guide surface. This arrangement causes the inner edges of the coins to be forced inwardly over the inner guide surface so that the inner edges of the coins of each denomination are positioned at a unique radius, different from the radial locations of the outer edges of the coins of all other denominations. This permits discrimination among the coins of different denominations according to the radial positions of the inner edges of the coins in the same manner described above. With this arrangement, the coins are all discharged at a common circumferential location (rather than being recycled to the central region of the sorter) when the guide members are retracted.

We claim:

1. A disc-type coin sorter having a rotatable disc with a resilient top surface and a stationary sorting head positioned above said disc with the lowermost surface of the sorting head only slightly spaced from the resilient top surface of the disc, said sorting head having coin queuing means for arranging coins of mixed denominations in a single row and a single layer with selected edges of the coins aligned at a common radial position, a first guide surface for engaging selected edges of the aligned coins and progressively moving the engaged coins radially as the coins move circumferentially along said first guide surface, a plurality of elongated second guide surfaces spaced radially from, and facing toward, said first guide surface for forcing coins of selected denominations under and past said first guide surface at selected circumferential locations, each of said elongated second guide surfaces being elongated in the direction of coin movement and having a substantially constant radius from the axis of rotation of said disc so that the coins engaged thereby are not moved radially, the distance between said first and second guide surfaces progressively decreasing in the circumferential direction so that coins of progressively smaller diameter are engaged by successive second guide surfaces, and said plurality of second guide surfaces being located at different radial distances from said axis of rotation so that the edges of each denomination of coin forced past said first guide surface are located at a unique radial position, thereby permitting discrimination among coins of different denominations according to the radial positions of the edges of said coins.

2. The coin sorter of claim 1 which includes means for retracting said second guide surfaces from the path of the coins on said disc so that the coins can be recycled in response to the detection of a selected condition.

3. The coin sorter of claim 1 which includes counting means connected to said second guide surfaces for sensing the engagement of each separate coin with one of said second guide surfaces.

4. The coin sorter of claim 1 further including means for permitting discrimination among coins of different denominations according to the radial positions of the inner edges of said coins.

5. A disc-type coin sorter having a rotatable disc with a resilient top surface and a stationary sorting head positioned above said disc with the lowermost surface of the sorting head only slightly spaced from the resilient top surface of the disc, said sorting head having coin queuing means for arranging coins of mixed denominations in a single row and single layer with selected edges of the coins aligned at a common radial position, a first guide surface for engaging selected edges of the aligned coins and progressively moving the engaged coins radially as the coins move circumferentially along said first guide surface, a plurality of elongated second guide surfaces spaced radially from, and facing toward, said first guide surface for forcing coins of selected denominations under and past said first guide surface at selected circumferential locations, each of said elongated second guide surfaces being elongated in the direction of coin movement and having a substantially constant radius from the axis of rotation of said disc so that the coins engaged thereby are not moved radially, the distance between said first and second guide surfaces progressively decreasing in the circumferential direction so that coins of progressively smaller diameter are engaged by successive second guide surfaces, and said plurality of second guide surfaces arranged with respect to said axis of rotation and the first guide surface so that the edges of each denomination of coin forced past said first guide surface are located at a unique radial position, thereby permitting discrimination among coins of different denominations according to the radial positions of the edges of said coins.

6. The coin sorter of claim 5 further including means for permitting discrimination among coins of different denominations according to the radial positions of the inner edges of said coins.

7. A disc-type coin sorter having a rotatable disc with a resilient top surface and a stationary sorting head positioned above said disc with the lowermost surface of the sorting head only slightly spaced from the resilient top surface of the disc, said sorting head having coin queuing means for arranging coins of mixed denominations in a single row and a single layer with selected edges of the coins aligned at a common radial position, a first guide surface for engaging selected edges of the aligned coins and progressively moving the engaged coins circumferentially along said first guide surface, a plurality of elongated second guide surfaces spaced radially from, and facing toward, said first guide surface for forcing coins of selected denominations under and past said first guide surface at selected circumferential locations, each of said elongated second guide surfaces being elongated in the direction of coin movement and having a substantially constant radius from the axis of rotating of said disc so that the coins engaged thereby are not moved radially, the distance between said first and second guide surfaces progressively decreasing in the circumferential direction so that coins of progressively smaller diameter are engaged by successive second guide surfaces, and said plurality of second guide surfaces arranged with respect to said axis of rotation and the first guide surface so that the edges of each denomination of coin forced past said first guide surface are located at a unique radial position, thereby permitting discrimination among coins of different denominations according to the radial positions of the edges of said coins.

8. The coin sorter of claim 7 further including means for permitting discrimination among coins of different denominations according to the radial positions of the inner edges of said coins.

* * * * *